United States Patent [19]

Rauschenberg et al.

[11] 4,101,166

[45] Jul. 18, 1978

[54] CHAIR CONTROL MECHANISM

[75] Inventors: Richard A. Rauschenberg, N. Jackson; Melvin A. Textoris, Struthers; Philip J. Williams, Poland, all of Ohio

[73] Assignee: GF Business Equipment, Inc., Youngstown, Ohio

[21] Appl. No.: 813,652

[22] Filed: Jul. 7, 1977

[51] Int. Cl.[2] ..... A47C 3/00

[52] U.S. Cl. ..... 297/304; 297/306

[58] Field of Search ..... 297/298, 300, 304, 305, 297/306

[56] References Cited

U.S. PATENT DOCUMENTS

| | | | |
|---|---|---|---|
| 2,051,043 | 8/1936 | Herold | 248/378 X |
| 2,056,965 | 10/1936 | Herold | 297/304 |
| 2,087,254 | 7/1937 | Herold | 297/304 X |
| 3,034,828 | 5/1962 | Kurihara | 297/306 |
| 3,111,343 | 11/1963 | Pearson | 297/306 |
| 3,402,964 | 9/1968 | Williams | 297/304 |
| 3,601,444 | 8/1971 | Doerner | 297/300 |
| 3,758,157 | 9/1973 | Fries | 297/300 |
| 3,881,772 | 5/1975 | Mohrman | 297/300 |
| 4,013,257 | 3/1977 | Paquette | 297/304 X |

*Primary Examiner*—Lawrence J. Staab

*Attorney, Agent, or Firm*—Emory L. Groff, Jr.

[57] ABSTRACT

A control mechanism for a tilt back chair includes a control body supported in a relatively stationary position by an integral vertical post member. A torsion unit is freely mounted between two flanges of the control body rearwardly of the post member and includes two spring-urged components respectively joined to a rearwardly extending tilt bracket and a forwardly extending tension lever. The tension lever includes a medial opening freely surrounding the post member and adjustment means acting upon its forward edge to vary the angular relationship between the tension lever and control body and thus the torque being applied to the tilt bracket.

14 Claims, 6 Drawing Figures

CHAIR CONTROL MECHANISM

This invention relates generally to a chair control device and more particularly to an improved mechanism permitting of tiltable displacement of a chair back while allowing of selective regulation of the force resisting such tilting of the chair back.

numerous efforts have been made to provide chair control mechanisms pursuant to the foregoing introduction and an exemplary control device will be found in U.S. Pat. No. 3,881,772 issued May 6, 1975, to Mohrman. By the present arrangement an improvement is provided wherein a control body having a suitable chair seat thereupon is affixed to a support post assembly and serves to carry a suitable tilt torsion unit to the rear of the post assembly. Projecting forwardly from this torsion unit is a tension lever having a forward portion disposed in front of the post assembly and engageable by a hand wheel carried by the fore portion of the control body and manipulation of which serves to alter the tension within the torsion unit, which tension is transmitted to a tilt bracket attached to the torsion unit and projecting rearwardly therefrom.

The torsion unit of the instant invention includes an axle pin having a pair of radially spaced apart sleeves concentrically disposed thereupon and joined together by means of one or more resilient elastomeric elements such that relative angular rotation between the two sleeves varies the resistant torsional force applied thereto by means of the resilient elements. The foregoing general concept is broadly well known and has been utilized for years in providing torsion units for chair control mechanisms. An early example of the concept will be found in U.S. Pat. No. 2,051,043 issued Aug. 18, 1936, to Herold. The present invention employs a specific distinctive relationship between the various components of the tilt torsion unit and the remaining elements of the control mechanism comprising the tilt bracket, tension lever and control body such that a vastly improved arrangement is provided offering convenient front access to the tension adjustment means controlling displacement of the chair back member and involving a more reliable and efficient construction.

Accordingly, one of the objects of the present invention is to provide an improved chair control mechanism including a tilt torsion unit limiting both the degree of angular displacement of a chair back member and providing means for regulating the amount of resistant tension affecting displacement of said back member.

Another object of the present invention is to provide an improved chair control mechanism including a torsion unit carried by a control body and including a tilt bracket and tension lever angularly affixed to relatively displaceable components of the torsion unit and projecting in opposite directions therefrom with tension adjustment means carried by the forward portion of the control body and engaging the forward portion of the tension lever.

A further object of the present invention is to provide an improved chair control mechanism including a tilt torsion unit freely mounted upon an axle carried by a horizontally stable control body and including a tilt bracket angularly affixed to an inner sleeve surrounding said axle pin and projecting rearwardly thereof to support a chair back member.

Still another object of the present invention is to provide an improved chair control mechanism including a tilt torsion unit freely carried by a control body at a point rearwardly of a chair post assembly attached to the control body and including a tilt bracket affixed to an inner sleeve of the torsion unit and having a notch thereon engageable with means fixed relative to control body to limit the degree of angular displacement of the tilt bracket.

An additional object of the present invention is to provide an improved chair control mechanism including a relatively stationary control body affixed to a chair post assembly and supporting a torsion unit to the rear thereof with a tension lever attached to an outer sleeve of the torsion unit and extending forwardly of the post assembly without attachment thereto and having a forward edge engageable by hand manipulable means carried by the forward portion of the control body to alter the angular disposition of the tension lever.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several views of the drawings.

Figure 1:
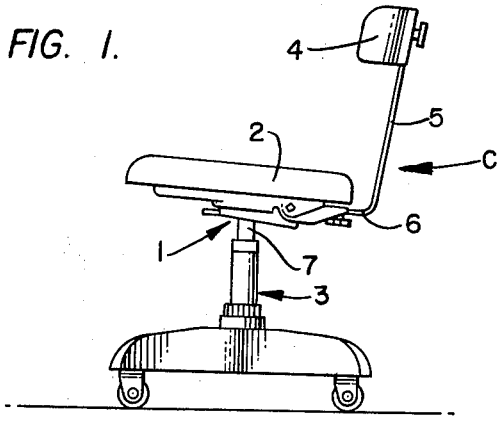
FIG. 1 is a side elevation of a typical chair provided with the control mechanism of the present invention.

Referring now to the drawings, particularly FIG. 1, the present invention will be seen to comprise a chair control mechanism generally designated 1, adapted to be located beneath the seat 2 and mounted upon a suitable support post assembly 3 of a chair C such as used by secretaries. As will be appreciated by those skilled in the art, such chairs include a seat which is mounted for swivel displacement yet is horizontally stable when in use, and it is customary to provide means for allowing of a rearward tilting displacement of the back rest 4 upon the application of pressure by the back of the user. Accordingly, tension means are provided to permit a controlled rearward displacement of the back member 5 having the back rest 4 attached to its upper end while its lower end 6 is attached to the control mechanism 1.

The control mechanism 1 of the instant invention is carried by the support post assembly 3 by means of a post collar 7 having its upper end suitably secured, such as by welding or staking as at 8, to the planar central web 9 forming an integral part of the control body 10. The control body 10 further includes a pair of spider portions 11—11 for attachment of the seat 2 and which will be seen to be inclined downwardly and rearwardly from the front 12 thereof to the rear 13 when the chair control is installed upon a chair post assembly 3 by means of its collar 7.

The central web 9 is bounded by a pair of longitudinal channel sections 14—14 which in turn are joined to the respective adjacent spider portions 11—11 by means of the vertical side flanges 15—15. The foregoing structure results in the formation of a downwardly facing bottom web channel 16, the purpose of which will become obvious hereinafter.

Figure 3:
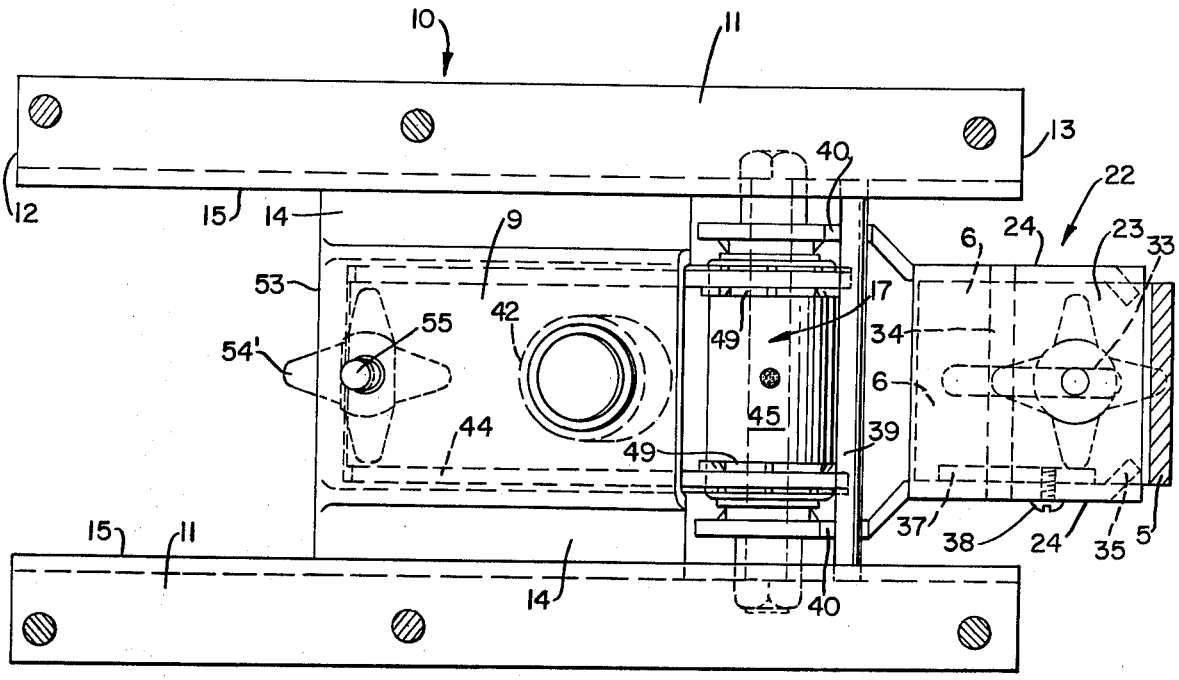
FIG. 3 is a top plan view of the control mechanism illustrated in FIG. 2.
Figure 4:
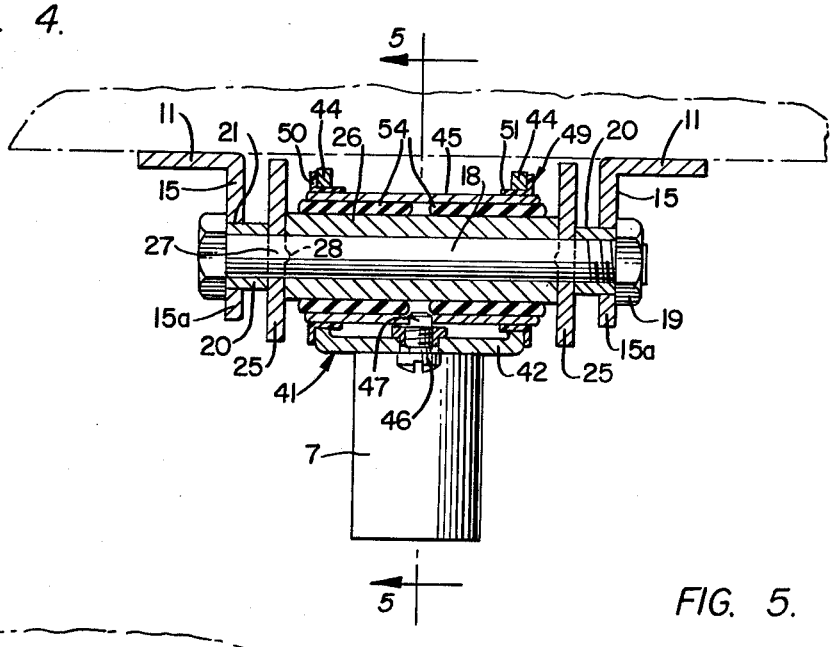
FIG. 4 is a vertical sectional view taken along the line 4—4 of FIG. 2.
Figure 6:
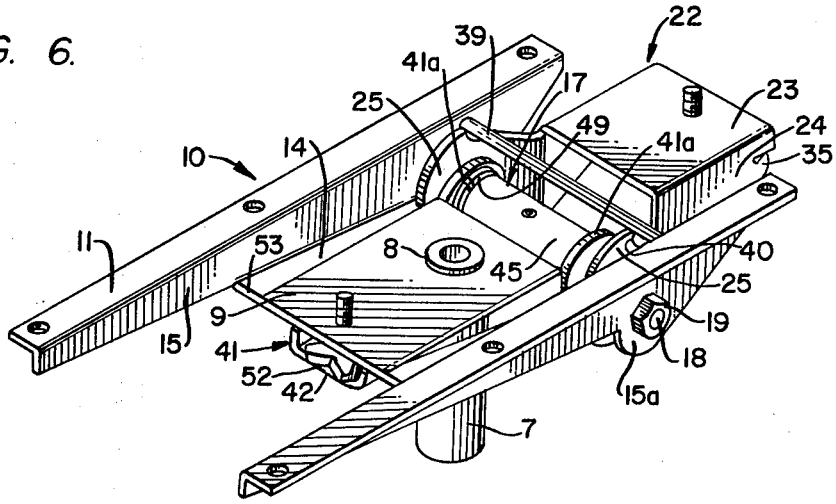
FIG. 6 is a top perspective view of the control mechanism shown in FIGS. 2 and 3.

As shown most clearly in FIGS. 4 and 6, the area of the control body side flanges 15 disposed to the rear of the post collar 7 is enlarged at 15*a*, and serves to support the tilt torsion unit 17 by means of the axle pin 18 which is freely disposed through the side flanges 15 of the control body and the interior of the torsion unit 17 and retained by means of the nuts 19. To reduce friction and inhibit unwanted noises, a bearing/spacer 20 comprising a sleeve of anti-friction material is preferably disposed around each end of the axle pin 18 and closely fitted within an enlarged hole 21 formed in the portion 15*a* of the control body side flanges. Next mounted upon the axle pin 18 is the tilt bracket, generally designated 22 and which is shown most clearly in FIGS. 3, 4 and 6 of the drawings. The tilt bracket 22 includes a planer top wall 23 form which depend a pair of side walls 24—24 terminating in the forward side arms 25—25, each of which surrounds the axle pin 18 immediately adjacent the inner end of the two bearing/spacers 20—20. Concentrically disposed about the axle pin 18 between the two spaced apart tilt bracket side arms 25 is an inner sleeve 26 which is free to rotate relative the axle pin 18 yet is angularly affixed relative the tilt bracket side arms 25 by means of the lugs 27 projecting inwardly from each of the side arms 25 and engageable within mating detents 28 formed in the end walls of the inner sleeve 26.

With the foregoing in mind it will thus be seen that any angular displacement of the tilt bracket 22 will result in a corresponding angular displacement of the torsion unit inner sleeve 26 without any displacement of the axle pin 18 or control body 10.

Figure 5:
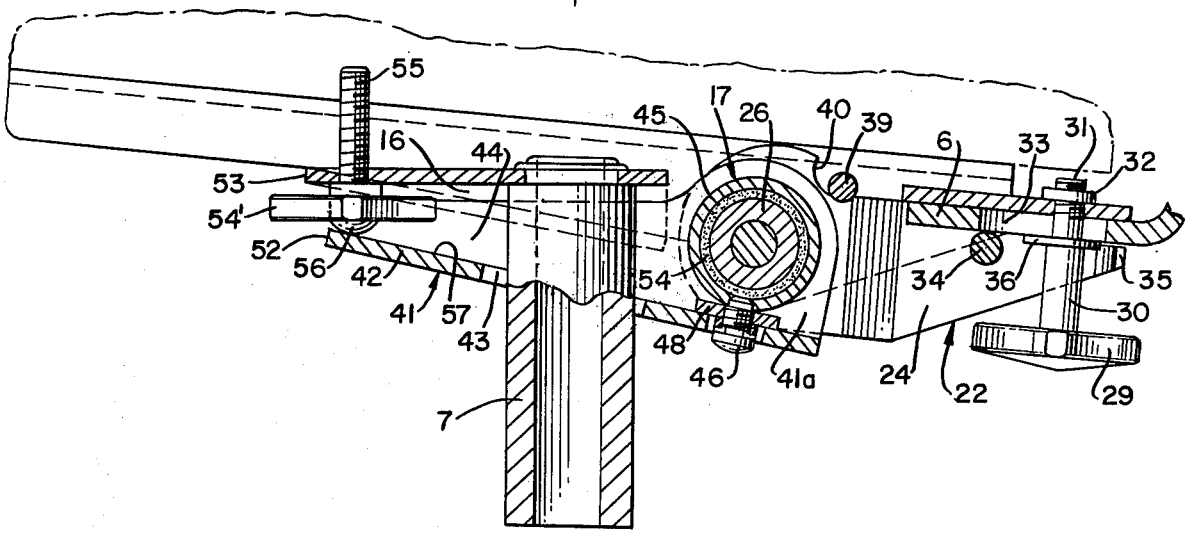
FIG. 5 is a longitudinal sectional view taken along the line 5—5 of FIG. 4.

The afore-described tilt bracket 22 serves to support the lower end 6 of the back member 5 and as will be seen, particularly in FIG. 5 of the drawings, means are provided to facilitate the attachment of the back member 5 to the tilt bracket 22 and to allow of limited longitudinal adjustment therebetween. The back member adjusting hand wheel 29 includes an enlarged shank 30 terminating in a reduced diameter screw 31 engageable with the weld nut 32 affixed to the upper surface of the tilt bracket top wall 23. Alternatively, of course, the top wall 23 may be threaded to accept the screw 31. The lower end 6 of the back member 5 is provided with a longitudinal slot 33 of a width accepting of the screw 31 and permitting of limited longitudinal displacement thereof prior to tightening of the hand wheel 29 to secure the entire back member 5 relative the tilt bracket 22.

Additional means are included to assist in guiding and supporting the lower end 6 of the back member 5 during initial assembly thereof as well as during subsequent adjustment thereof. This comprises a back member guide pin 34 fixedly mounted between the two side walls 24 of the tilt bracket 22 and having its upper surface spaced downwardly from the top wall 23 thereof a distance allowing of a close sliding fit of the lower end 6 of the back member 5 as shown in FIG. 5 of the drawings. Additionally, a pair of inwardly directed tabs 35 are struck inwardly from the rear of the tilt bracket side walls 24 and the upper surface of each of these tabs is likewise disposed at substantially the same distance from the top wall 23 as the upper surface of the guide pin 34. With the foregoing structure in mind, it will be seen that upon loosening of the back member adjusting hand wheel 29, the shank 30 thereof will be lowered together with the associated washer 36, yet the back member 5 will still be retained within the confines of the tilt bracket side wall 24 by means of the guide pin 34 and inwardly directed tabs 35.

Further means are also included to preclude unwanted removal or dropping of the back member 5 should the screw 31 of the hand wheel be completely removed from its nut 32. As shown in FIG. 3 of the drawings, one side edge of the back member lower end 6 is notched as at 37 to provide a cut-out portion substantially as long as the slot 33. Cooperating with this notch is a removable screw 38 passing through and threadedly engaging the adjacent side wall 24 of the tilt bracket 22 and having a distal portion freely disposed within the back member notch 37.

Means in the form of a stop pin 39 are provided to restrict the angular displacement of the tilt bracket 22 and its attached back member 5. This stop pin 39 is fixedly mounted in the two side flanges 15 of the control body 10 and as will be seen in FIGS. 2 and 5 of the drawings, is disposed rearwardly and above the plane of the torsion unit axle 18 and cooperates with a notch 40 formed in each of the two tilt bracket side arms 25. The notches 40 are configured to provide two opposite stop surfaces allowing of approximately a 16° angular displacement or tilt of the tilt bracket 22 when an operator sitting in the chair applies a rearward force to the back rest 4. The notch 40 and the cooperating stop pin 39 are shown in the various figures of the drawings as they would appear when the chair control mechanism is at its at-rest position, that is, when no overcoming force is being applied to the back member 5 and the tilt torsion unit 17 is maintaining the back member 5 in its forwardmost position.

The remaining principal component of the chair contro mechanism 1 will now be described. This comprises the tension lever 41 having a bottom web 42 provided with a central opening 43 surrounding and substantially larger than the diameter of the post member or collar 7. Projecting upwardly from the bottom web 42 are a pair of side walls 44—44, the rear portions 41a of which are disposed inwardly of the tilt bracket forward side arms 25 and surroundingly engage the exterior of an outer sleeve 45 surrounding and radially spaced from the inner sleeve 26 of the tilt torsion unit 17.

The tension lever 41 is rigidly affixed to the outer sleeve 45 by means of fastening means comprising a screw 46 disposed through an opening in the bottom web 42 of the tension lever and having a distal nose 47 tightly disposed within an opening provided in the medial portion of the outer sleeve 45. As shown in FIGS. 4 and 5 of the drawings, the threaded portion of the screw 46 is retained by means of a weld nut 48, yet any appropriate alternative arrangement may be employed such as tapping the opening in the tension lever web 42 with a thread mating with the thread of the screw 46.

In many prior torsion units wherein a tension lever or tilt bracket surrounds and is affixed to an outer sleeve thereof, it has been common for an objectionable noise to be created during the use of the device, which is caused by a slight deflection of the side walls against the outer periphery of the outer sleeve during flexing of the torsion unit such that an annoying squeaking sound is often heard. Accordingly, it is proposed to obviate this objection by the inclusion of a split bushing 49, preferably of synthetic plastic composition, between the outer periphery of the outer sleeve 45 and the opening of the tension lever side walls 44, as shown most clearly in FIGS. 3 and 4 of the drawings. The bushings 49 preferably include an outer radially extending flange 50 joined to an axially extending collar 51 with the latter disposed between the outer sleeve 45 and opening in the tension lever side walls 44.

The forward edge 52 of the tension lever 41 projects well forwardly of the post collar 7 to a point substantially adjacent the forward edge 53 of the control body web 9, and as will be seen most clearly in FIGS. 3 and 5 of the drawings, the side walls 44 thereof are disposed within the confines of the bottom web channel 16 of the control body.

The final component of the tilt torsion unit 17 comprises spring means including one or more resilient or elastomeric elements 54 disposed intermediate the spaced apart concentrically arranged inner and outer sleeves 26 and 45. The inner and outer peripheries of the resilient element 54 are respectively suitable affixed to the juxtaposed exterior surface of the inner sleeve 26 and interior surface of the outer sleeve 45, respectively, by any suitable means. As previously described, the chair control mechanism 1 is illustrated as it appears when in the at-rest position, that is, when the tilt bracket 22 and its attached back member 5 are in the maximum upward and forward position, and wherein the tilt bracket is rotated or arcuately displaced its maximum distance counter-clockwise as viewed in FIGS. 2 and 5 of the drawings, with the right hand edge of the tilt bracket side arm notches 40 abutting the stationary stop pin 39.

Figure 2:
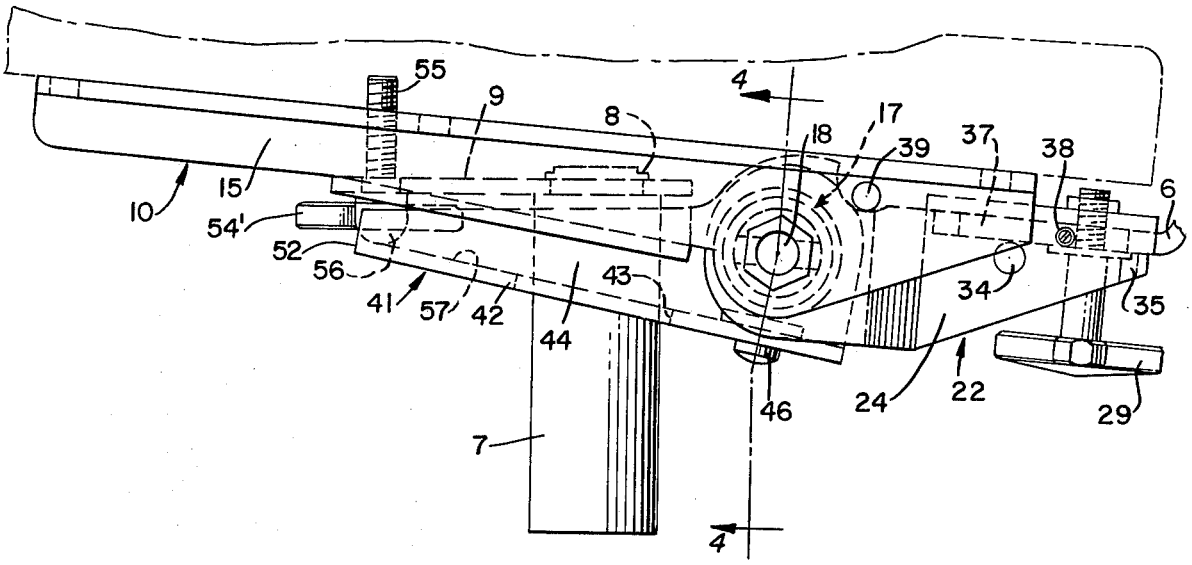
FIG. 2 is an enlarged side elevation of the chair control mechanism.

The tension lever 41 and tilt bracket 22 are initially assembled with respect to the tilt torsion unit 17 so that at least a nominal amount of torsion is stored within the unit 17 when the components appear as at FIGS. 2 and 5 of the drawings. In other words, it will be seen that the forward edge 52 of the tension lever is disposed in its uppermost position such that the tension lever is arcuately disposed or rotated to its maximum clockwise position, as permitted by the position of a tilt tension adjusting hand wheel 54'. This hand wheel includes a screw 55 either threadedly disposed through a tapped opening adjacent the forward edge 53 of the control body web 9 as shown in FIG. 5, or alternatively, engaging a suitable weld nut (not shown) affixed to the control body web. The lower surface of the hand wheel 54' is provided with a contact nose 56 adapted to engage the upper surface 57 of the tension lever bottom web 42. With the above structure in mind it will follow that upon manipulation of the hand wheel 54' from the position as shown in FIGS. 2 and 5 of the drawings, the screw 55 will be displaced downwardly along with the hand wheel contact nose 56 whereupon the forward edge 52 of the tension lever will be biased downwardly or in a counterclockwise direction about the torsion unit axle 18, thereby significantly increasing the resistant force of the torsion as generated by the resilient elements 54 as the torsion unit outer sleeve 45 is arcuately displaced along with the tension lever 41, while the torsion unit inner sleeve 26 remains stationary, due to its fixation relative the side arms 25 of the tilt bracket 22. The more the hand wheel 54' is manipulated to displace its screw 55 and contact nose 56 downwardly, the greater the counter-clockwise displacement of the tension lever 41, and accordingly the greater the torsion generated within the torsion unit 17, whereby it will be apparent that a greater resistance will be built up so that more force would be required to displace the back rest 4 and its attached back member 5 by a user of the chair seat.

We claim:

1. A chair control mechanism including, a control body provided with a pair of spaced apart side flanges and having a medially disposed central web therebetween, a post member depending from said web, a tilt torsion unit transversely disposed between said side flanges, an axle pin spanning said side flanges and supporting said torsion unit rearwardly of said web and post member, a tilt bracket having a pair of side arms extending forwardly from a rear portion and affixed to said torsion unit, an inner sleeve freely mounted about said axle pin between said side arms and fixed to said side arms, an outer sleeve surrounding said inner sleeve and spaced therefrom, spring means joining the interior of said outer sleeve to the exterior of said inner sleeve and applying a torsional force therebetween, a tension lever including a bottom web joined to a pair of side walls, said bottom web having a forward edge disposed beneath and adjacent the forward edge of said control body web and including a rear portion disposed beneath said torsion unit, said torsion lever bottom web including an opening freely surrounding said post member, said tension lever side walls adjacent said rear portion surrounding said torsion unit outer sleeve, means affixing said tension lever to said outer sleeve whereby, said torsion unit spring means concurrently urges said tension lever forward portion upwardly toward said control body web and said tilt bracket rear portion upwardly toward said control body and adjustment means forward of said post member and intermediate said control body web and tension lever web manipulable to alter the angular disposition of said tension lever relative said control body and thus vary the torque acting upon said tilt bracket.

2. A chair control mechanism according to claim 1 wherein, said tilt bracket side arms surround said axle pin inwardly of said control body side flanges.

3. A chair control mechanism according to claim 1 including means arcuately affixing said tilt bracket side arms to said torsion unit inner sleeve.

4. A chair control mechanism according to claim 1 including means carried by said tilt bracket and control body to limit arcuate displacement of said tilt bracket about said axle pin.

5. A chair control mechanism according to claim 1 wherein, said control body includes a channel section joining each side of said central web to said side flanges, a spider portion attached to each said side flange for supporting a chair seat and said post member and control body form an integral unit with said central web disposed normal to said post member.

6. A chair control mechanism according to claim 1 wherein, said spring means includes an elastomeric element.

7. A chair control mechanism according to claim 1 wherein, said means affixing said tension lever to said outer sleeve includes a threaded fastener carried by said tension lever bottom web and closely fitted within an opening in said outer sleeve.

8. A chair control mechanism according to claim 1 wherein, said adjustment means includes a threaded element carried by said control body web and having a contact nose engageable with said tension lever web.

9. A chair control mechanism according to claim 1 including, a back member having a lower end removably attachable to said tilt bracket between said side arms, said tilt bracket haing a top wall joining the rear of said side arms, guide means disposed inwardly of said side arms beneath said top wall and spaced from said top wall to provide a close sliding fit of said lower end therebetween and releasable clamping means carried by said top wall and engaging said lower end.

10. A chair control mechanism according to claim 1 including, anti-friction bushings intermediate said tension lever side walls and said torsion unit outer sleeve.

11. A chair control mechanism according to claim 2 including, an anti-friction sleeve surrounding each end of said axle pin and maintaining said tilt bracket side arms spaced inwardly of said control body flanges.

12. A chair control mechanism according to claim 3 wherein, said affixing means includes mating lugs and detents on said side arms and inner sleeve.

13. A chair control mechanism according to claim 4 wherein, said limit means includes a notch formed in each said tilt bracket side arm and a stop pin carried by said control body flanges and disposed within said notches.

14. A chair control mechanism according to claim 9 including, means limiting longitudinal displacement of said lower end relative said tilt bracket, said limiting means including a medial slot in said lower end, said clamping means comprising a screw disposed through said slot, one edge of said lower end provided with a notch, a limit screw carried by one said side arm having a distal portion disposed within said notch whereby, upon complete removal of said clamping screw from said slot said lower end remains captive within said tilt bracket by said limit screw and guide means.

* * * * *